US009850590B2

(12) United States Patent
Hosokawa et al.

(10) Patent No.: US 9,850,590 B2
(45) Date of Patent: Dec. 26, 2017

(54) ANODIZED ALUMINUM FILM

(71) Applicant: Kobe Steel, Ltd., Kobe-shi (JP)

(72) Inventors: Mamoru Hosokawa, Kobe (JP); Satoru Takada, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 64 days.

(21) Appl. No.: 14/418,262

(22) PCT Filed: Sep. 24, 2013

(86) PCT No.: PCT/JP2013/075662

§ 371 (c)(1),
(2) Date: Jan. 29, 2015

(87) PCT Pub. No.: WO2014/050794

PCT Pub. Date: Apr. 3, 2014

(65) Prior Publication Data

US 2015/0211141 A1 Jul. 30, 2015

(30) Foreign Application Priority Data

Sep. 26, 2012 (JP) ..... 2012-212732

(51) Int. Cl.

| | |
|---|---|
| ***C25D 11/04*** | (2006.01) |
| ***C25D 11/06*** | (2006.01) |
| ***C25D 11/12*** | (2006.01) |
| *C25D 11/08* | (2006.01) |
| *C25D 11/10* | (2006.01) |

(52) U.S. Cl.

CPC ..... *C25D 11/04* (2013.01); *C25D 11/06* (2013.01); *C25D 11/12* (2013.01); *C25D 11/08* (2013.01); *C25D 11/10* (2013.01)

(58) Field of Classification Search

None

See application file for complete search history.

(56) References Cited

U.S. PATENT DOCUMENTS

| | | | | |
|---|---|---|---|---|
| 4,606,796 | A * | 8/1986 | Hanazima | C25D 11/18 205/174 |
| 5,277,788 | A * | 1/1994 | Nitowski | C25D 11/12 205/172 |
| 6,027,629 | A | 2/2000 | Hisamoto et al. | |
| 2008/0213618 | A1 * | 9/2008 | Critchlow | C25D 11/08 428/613 |
| 2012/0132529 | A1 | 5/2012 | Zekry et al. | |
| 2012/0256224 | A1 | 10/2012 | Hatanaka et al. | |

FOREIGN PATENT DOCUMENTS

| | | | |
|---|---|---|---|
| CN | 101962792 | A | 2/2011 |
| JP | 8 193295 | | 7/1996 |
| JP | 10138034 | A * | 5/1998 |
| JP | 2004001171 | A * | 1/2004 |
| JP | 2011-117042 | A | 6/2011 |
| JP | 2011 132586 | | 7/2011 |
| JP | 2011 157624 | | 8/2011 |
| JP | 2012-117144 | A | 6/2012 |
| JP | 2012-162769 | A | 8/2012 |

OTHER PUBLICATIONS

Hideki Masuda, et al., "Process to make anodic oxidation coating on aluminum thick—Produce a film having a thickness of 2 mm" Proceedings of ARS Conference, Oct. 1992, 4 Pages (with English translation).

International Search Report and Written Opinion of the International Searching Authority Issued Dec. 17, 2013 in PCT/JP13/075662 Filed Sep. 24, 2013.

* cited by examiner

*Primary Examiner* — Vera Katz

(74) *Attorney, Agent, or Firm* — Oblon, McClelland, Maier & Neustadt, L.L.P.

(57) ABSTRACT

Provided is an anodized aluminum film formed on a surface of a substrate that comprises aluminum or an aluminum alloy, the anodized aluminum film having a structure constituted of a single anodized film layer or a structure composed of superposed anodized film layers of two or more different kinds, wherein the outermost anodized film has a degree of film formation, defined by equation (1), of 1.3 or more and the proportion of the thickness of this anodized film in the entire film thickness is 3% or higher. Thus, the anodized aluminum film is inhibited from cracking in bent portions. As a result, the substrate is inhibited from corroding in corrosive-gas atmospheres, and a decrease in withstand voltage characteristics due to film cracking is inhibited. With this anodized aluminum film, enhanced withstand voltage characteristics can hence be attained:

Degree of film formation=(thickness of anodized film)/(substrate thickness loss by anodization) (1).

11 Claims, No Drawings

ANODIZED ALUMINUM FILM

TECHNICAL FIELD

The present invention relates to an anodized aluminum film preferably used for an aluminum member having an anodized film on a substrate of aluminum alloy useful as a material for a vacuum chamber of manufacturing equipment of semiconductor or liquid crystal, the equipment including a dry etching apparatus, a chemical vapor deposition (CVD) apparatus, an ion implantation apparatus, and a sputtering apparatus, or useful as a material of a component provided within the vacuum chamber. In particular, the invention relates to an anodized aluminum film that is improved in withstand voltage characteristics while cracking is suppressed in a curved portion.

BACKGROUND ART

There has been widely practiced anodizing that forms an anodized film on a surface of a member including a substrate of aluminum, aluminum alloy, or the like to improve plasma resistance and gaseous corrosion resistance of the substrate. For example, a vacuum chamber used in a plasma treatment apparatus of semiconductor manufacturing equipment or each of various components provided within the vacuum chamber is typically composed of aluminum alloy. However, if the aluminum alloy is used while being untreated (solid), its properties such as plasma resistance and gaseous corrosion resistance cannot be maintained. An anodized film is therefore provided on a surface of the member composed of aluminum alloy to improve plasma resistance, gaseous corrosion resistance, and the like.

In recent years, power to be applied for plasma generation increases with increase in plasma density due to narrowed interconnection width. In existing anodized films, therefore, dielectric breakdown may be induced by high temperature and high voltage occurring at high power application. Electric properties of the film are varied in a portion where such dielectric breakdown occurs, and therefore the film is less uniformly etched or formed in the portion. The anodized film is therefore desired to be improved in crack resistance and withstand voltage characteristics.

Various techniques have been previously proposed in order to improve properties of the anodized film. For example, PTL 1 suggests that pore size on a surface side of an anodized film is controlled to be small on a side near a film surface and large on a side near a substrate, thereby the anodized film is reduced in reactivity to plasma so as to improve plasma resistance. Such an anodized film can be extremely improved in plasma resistance compared with existing anodized films. In such an anodized film, however, cracking (hereinafter sometimes referred to as "curved-portion cracking") may also occur in a curvature portion (curved portion) that may exist in actual equipment. This may lead to an environment under which the substrate and the anodized film are each easily corroded.

CITATION LIST

Patent Literature

PTL 1: Japanese Unexamined Patent Application Publication No. Hei8 (1996)-193295.

SUMMARY OF INVENTION

Technical Problem

An object of the invention, which has been made in light of the above-described circumstances, is to provide an anodized aluminum film that is improved in withstand voltage characteristics by suppressing curved-portion cracking and therethrough suppressing corrosion of a substrate under corrosive gas atmosphere and degradation in withstand voltage characteristics due to film cracking.

Solution to Problem

According to the present invention, there is provided an anodized aluminum film, by which the object is achieved, formed on a surface of a substrate including aluminum or aluminum alloy, the anodized aluminum film including an anodized film having a monolayer film structure or at least two laminated anodized films having different film structures, a top-side anodized film having a degree of film formation of 1.3 or more, the degree of film formation being defined by Formula (1), and having a thickness percentage of 3% or more relative to the entire film thickness.

$$\text{Degree of film formation} = (\text{thickness of anodized film})/(\text{substrate thickness loss by anodization}) \quad (1)$$

The anodized aluminum film of the invention preferably has a smaller thickness of the entire film in light of suppressing cracking, but extremely small thickness thereof anxiously leads to degradation in corrosion resistance; hence, the total thickness should be, for example, 3 μm or more. The entire film thickness is preferably 20 μm or more (more preferably 25 μm or more) in light of maintaining withstand voltage characteristics. The entire film thickness refers to thickness of one film for a monolayer film structure, and refers to the total film thicknesses of respective layers for a multilayer film structure including at least two laminated anodized films having different film structures.

When the anodized aluminum film of the invention includes at least two laminated anodized films having different film structures, a substrate-side anodized film has a degree of film formation of less than 1.3, the degree of film formation being defined by Formula (1), and has a thickness percentage of 10% or more relative to the entire film thickness.

The at least two anodized films having different film structures should be prepared with different treatment solutions or treatment conditions for formation of the anodized films.

Advantageous Effects of Invention

According to the invention, the top-side anodized aluminum film is controlled to have a degree of film formation of 1.3 or more, the degree of film formation being defined by the predetermined relational expression, and thickness of the top-side anodized film is defined to be within a predetermined range, thereby an anodized aluminum film having high withstand voltage characteristics is achieved.

DESCRIPTION OF EMBODIMENTS

The inventors have made investigations from various angles to produce an anodized aluminum film (sometimes simply referred to as "anodized film" hereinafter) that is suppressed in curved-portion cracking. As a result, the inventors have found that when at least a top-side anodized film is formed such that the degree of film formation defined by the predetermined relational expression is 1.3 or more, and when thickness of the top-side anodized film is defined to be within a predetermined range, an anodized film, which enables the above-described object to be achieved, is given, and finally they have completed the invention.

It is considered that cracking basically occurs in a curved portion when volume loss (i.e., thickness loss) of a substrate by anodizing is not sufficiently filled with the anodized film to be formed. The anodized film is therefore designed to have a degree of film formation of 1.3 or more, the degree of film formation being defined by Formula (1), thereby the volume loss of the substrate can be filled with the anodized film, and the curved-portion cracking can be suppressed. Although the degree of film formation of 1.0 or more is considered to be high enough to fill the volume loss of the substrate with the anodized film, such an anodized film has failed to achieve the object. In other words, the object has been achieved only by the anodized film having the degree of film formation of 1.3 or more.

One possible reason why such a phenomenon occurs is estimated to be that the anodized film having the degree of film formation of 1.3 or more is easily stretched due to a variation in structure (internal film structure) of the film itself, and thus the film is increased in stretch rate to a stress applied on the film, and consequently the curved-portion cracking is less likely to occur.

The degree of film formation is preferably 1.5 or more, more preferably 1.7 or more, and further preferably 2.0 or more. The degree of film formation can be adjusted by appropriately controlling a condition of the anodizing (as described later). However, if treatment time is increased, a surface of the anodized film is dissolved in a treatment solution, and thickness of the film is decreased; hence, the degree of film formation is limitedly increased up to a certain value. The upper limit of the degree of film formation is typically about 3.

In light of suppressing the curved-portion cracking, thickness of an anodized film having a degree of film formation of 1.3 or more (such a film may be referred to as "top-side film") is preferably 3% or more in percentage to the entire film thickness. It is preferred that the entire film thickness is specifically 3 μm or more.

The anodized film of the invention includes the following two cases, i.e., a case where a film structure (laminated film structure) is a monolayer structure, and a case where the film structure is a multilayer structure including at least two layers having different film structures. For the monolayer, the anodized film has a thickness percentage of 100% relative to the entire film thickness, and the preferable lower limit, 3 μm or more, of the entire film thickness corresponds to thickness of one layer. A substrate-side anodized film also has a degree of film formation of 1.3 or more.

In the withstand voltage characteristics to be required, withstand voltage of the anodized film as a whole (or withstand voltage of a planar portion) is preferably 600 V or more (more preferably 1000 V or more, and further preferably 1500 V or more). Since withstand voltage characteristics of the anodized film as a whole is in proportion to film thickness for the same film structure, the entire film thickness (total thickness) is preferably 20 μm or more in order to maintain good withstand voltage characteristics. The entire film thickness is more preferably 25 μm or more (further preferably 30 μm or more, and most preferably 40 μm or more). However, if the entire film thickness is increased, the film is easily cracked due to internal stress of the film, and withstand voltage is rather lowered; hence, the total thickness is preferably 200 μm or less (more preferably 100 μm or less).

The anodized film (top-side film) having a degree of film formation of 1.3 or more tends to be increased in leakage current during measurement of withstand voltage. If the leakage current increases, a feeble current may flow through the film while not lead to film breakage caused by dielectric breakdown. This tends to cause a problem such as plasma abnormal discharge in a semiconductor process, for example.

The inventors have also made investigations in light of solving such a problem. As a result, it has been found that since leakage current is less likely to occur in the anodized film having a degree of film formation of less than 1.3 (such a film may be referred to as "substrate-side film"), if such a film is provided on a substrate side, leakage current can be inhibited.

Specifically, the anodized film is designed to have a film structure (laminated film structure) where the anodized film having a degree of film formation of less than 1.3 is provided on the substrate side, and the anodized film having a degree of film formation of 1.3 or more is provided on the top side, thereby crack resistance can be suppressed, and leakage current can be decreased. When such a laminated film structure is used, thickness of the substrate-side film is preferably 10% or more (i.e., thickness of the top-side film is 90% or less), more preferably 20% or more (further preferably 30% or more), relative to the entire film thickness in order to effectively allow the above-described effects to be exhibited.

When the anodized film of the invention includes at least two laminated layers having different film structures, and if at least the requirement for the anodized film provided on each of the top side and the substrate side is satisfied, the object of the invention can be achieved. However, this is not intended to limit the film structure (laminated film structure) of the anodized film of the invention to the two-layer structure. The film structure may include a three-layer structure and a four-layer structure as long as such requirements are satisfied. However, if the number of such laminated layers is excessively large, the treatment process is complicated, and the effects are not further effectively exhibited; hence, the number is appropriately up to four.

The at least two anodized films having different film structures should be prepared with different treatment solutions or treatment conditions (described later) for formation of the anodized films.

The anodized film having a degree of film formation of 1.3 or more should be basically formed through increasing temperature of a treatment solution, and decreasing a treatment voltage or current density depending on a type of an anodizing solution (electrolytic solution) to be used. Specifically, when oxalic acid is used as the treatment solution, temperature of the treatment solution (solution temperature) is preferably about 20 to 30° C.

The voltage (electrolysis voltage) during anodizing is preferably about 30 to 60 V (more preferably 35 to 55 V). Alternatively, the current density of a current applied during anodizing is preferably 1.0 $A/dm^2$ or less (more preferably 0.8 $A/dm^2$ or less, further preferably 0.6 $A/dm^2$ or less). However, such specific conditions may be appropriately adjusted depending on a type of the treatment solution (the treatment solution composition) or a type of the substrate (including aluminum or aluminum alloy).

By contrast to such a condition, the anodized film having a degree of film formation of less than 1.3 should be basically formed through relatively decreasing temperature of the treatment solution (to about 10 to 20° C.), and increasing a treatment voltage or current density. Specifically, when oxalic acid is used as the treatment solution, the voltage (electrolysis voltage) during anodizing is preferably about 60 to 80 V (more preferably about 70 to 80 V). The current density of a current applied during anodizing preferably has a value larger than 1.0 A/dm$^2$ (more preferably 1.4 A/dm$^2$ or more).

The anodizing solution usable in the invention includes not only the above-described oxalic acid, but also, for example, organic acid such as formic acid, inorganic acid such as phosphoric acid, chromic acid, and sulfuric acid, and mixed acids thereof. The concentration of the anodizing solution should be appropriately controlled such that desired functions and effects are effectively exhibited. For example, the concentration is preferably controlled to be about 1 to 5% for oxalic acid.

The substrate used in the invention is composed of aluminum or aluminum alloy. Any type of aluminum or aluminum alloy, which is typically used for formation of an anodized film, may be used without limitation. For example, any of aluminum alloys of 1000 series (industrial pure Al), 5000 series, and 6000 series can be used. A commercially available aluminum alloy may also be used as the aluminum alloy.

The anodized film of the invention is decreased in cracking in a curved portion and improved in withstand voltage characteristics; hence, the anodized film can be preferably used for a vacuum chamber of manufacturing equipment of semiconductor or liquid crystal, or components provided within the vacuum chamber, such as a clamper, a shower head, and a susceptor. The anodized film of the invention may also be subjected to sealing such as boiling water sealing or pressurized-steam sealing in order to improve acid resistance in a wet process.

Although the invention is now described in detail with an example, the invention should not be limited thereto, and modifications or alterations thereof may be made within the scope without departing from the gist described before and later, all of which are included in the technical scope of the invention.

This application claims the benefit of Japanese Priority Patent Application JP 2012-212732 filed on Sep. 26, 2012, the entire contents of which are incorporated herein by reference.

EXAMPLE

A rolled material (base material) of 6061 alloy defined by JIS H 4000 was used as an aluminum alloy substrate, and a plurality of test specimens each having a size of 25 mm wide, 35 mm long (in a rolling direction), and 2 mm thick were cut out from the rolled material and were subjected to facing.

Subsequently, each of the specimens was anodized under a condition (including a treatment solution type, treatment solution temperature, and electrolysis voltage or electrolysis current density) shown in Table 1, and thus anodized films having various film structures (monolayer or multilayer) were prepared.

The degree of film formation, film thickness, and total thickness of each anodized film were measured according to the following procedures. Table 1 collectively shows results of such measurements.

(Measurement of Degree of Film Formation and Thickness of Anodized Film)

Part of a surface of the substrate was masked, and then the surface was anodized to form an anodized film. The resultant specimen was embedded in resin and polished, and was then observed along a film section direction by a light microscope. A position of the Al alloy in the masked portion was defined as an original substrate position, and a distance from the original substrate position to a substrate position in the portion where the anodized film was formed was defined as substrate thickness loss. Film thickness (i.e., thickness of each layer and total thickness) was measured through observation along the film section direction. The degree of film formation was obtained through calculation according to Formula (1) using the measured thicknesses. The measurement was performed in five portions in total, and the average of the measured values was obtained.

TABLE 1

| | | Film structure Top-side film | | | | | | | |
|---|---|---|---|---|---|---|---|---|---|
| Test No. | Treatment solution type | Treatment solution temperature (° C.) | Electrolysis voltage (V) | Electrolysis current density (A/dm$^2$) | Degree of film formation (—) | Determination of degree of film formation | Thickness (μm) | Thickness percentage relative to total thickness (%) | Determination of thickness |
| 1 | 5% oxalic acid | 30 | 40 | — | 2.3 | ○ | 2 | 18 | ○ |
| 2 | 5% oxalic acid | 30 | — | 0.8 | 2.3 | ○ | 5 | 20 | ○ |
| 3 | 4% oxalic add + 0.3% sulfuric add | 13 | 60 | — | 2.3 | ○ | 2 | 7 | ○ |
| 4 | 4% oxalic add + 0.3% sulfuric add | 13 | 60 | — | 2.3 | ○ | 19 | 38 | ○ |
| 5 | 4% oxalic add + 0.3% sulfuric add | 13 | 60 | — | 2.3 | ○ | 10 | 25 | ○ |
| 6 | 4% oxalic acid | 20 | 40 | — | 1.4 | ○ | 3 | 16 | ○ |
| 7 | 4% oxalic acid | 25 | 40 | — | 2.2 | ○ | 11 | 100 | ○ |
| 8 | 3% oxalic acid | 30 | — | 0.7 | 2.1 | ○ | 26 | 100 | ○ |
| 9 | 3% oxalic acid | 28 | 35 | — | 1.7 | ○ | 22 | 88 | ○ |
| 10 | 3% oxalic add + 0.1% sulfuric acid | 13 | 50 | — | 2.3 | ○ | 2 | 18 | ○ |
| 11 | 5% oxalic acid | 17 | — | 1.4 | 1.2 | X | 27 | 100 | ○ |
| 12 | 3% oxalic acid | 17 | 80 | — | 1.1 | X | 50 | 100 | ○ |

TABLE 1-continued

| | | | | | | | | | |
|---|---|---|---|---|---|---|---|---|---|
| 13 | 3% oxalic acid | 30 | 40 | — | 2.1 | ○ | 1 | 2 | X |
| 14 | 3% oxalic add + 0.1% sulfuric acid | 13 | 50 | — | 2.3 | ○ | 1 | 2 | X |
| 15 | 2% oxalic acid | 17 | 70 | — | 1.2 | X | 3 | 43 | ○ |

| | Film structure | | | | | |
|---|---|---|---|---|---|---|
| | Substrate-side film | | | | | |
| Test No. | Treatment solution temperature (° C.) | Electrolysis voltage (V) | Electrolysis current density (A/dm$^2$) | Thickness (μm) | Degree of film formation (—) | Total thickness (μm) |
| 1 | 17 | 80 | — | 9 | 1.2 | 11 |
| 2 | 17 | — | 1.4 | 20 | 1.2 | 25 |
| 3 | 10 | 60 | — | 20 | 1.1 | 22 |
| 4 | 17 | 70 | — | 30 | 1.1 | 49 |
| 5 | 17 | 70 | — | 30 | 1.1 | 40 |
| 6 | 10 | 60 | — | 16 | 1.1 | 19 |
| 7 | — | — | — | 0 | — | 11 |
| 8 | — | — | — | 0 | — | 26 |
| 9 | 18 | — | 1.3 | 3 | 1.1 | 25 |
| 10 | 10 | 60 | — | 9 | 1.2 | 11 |
| 11 | — | — | — | 0 | — | 27 |
| 12 | — | — | — | 0 | — | 50 |
| 13 | 17 | 80 | — | 40 | 1.1 | 41 |
| 14 | 10 | 60 | — | 40 | 1.2 | 41 |
| 15 | 18 | 70 | — | 4 | 1.0 | 7 |

For each of the anodized films (Test Nos. 1 to 15), occurrence of curved-portion cracking was evaluated, and withstand voltage and leakage current were measured. Table 2 shows results of them.

(Evaluation of Occurrence of Curved-Portion Cracking)

With the curved-portion cracking, occurrence of curved-portion cracking was observed along a film surface direction by a light microscope with 100× and 200× magnifications in a curved portion (a portion with R of 2 mm) of each test specimen. In the case where a distinct crack existed in the film surface, crack resistance was determined to be bad ("x" in Table 2). In the case where no crack was viewed, crack resistance was determined to be good ("○" in Table 2).

(Measurement of Withstand Voltage and Leakage Current)

The withstand voltage and leakage current of each specimen were determined as follows. For the withstand voltage, a withstanding voltage tester ("TOS5051A" from KIKUSUI ELECTRONICS CORPORATION) was used in such a manner that a plus terminal was connected to a needle probe and was vertically brought into contact with the anodized film (a planar portion), a minus terminal was connected to the aluminum alloy substrate, a voltage was applied, and the withstand voltage characteristics were determined by a dielectric breakdown voltage (referred to as "planar-portion withstand voltage"). The leakage current in the planar portion (planar-portion leakage current) was measured in the same way. In each of Test Nos. 1 to 10, the planar-portion withstand voltage was 600 V or higher.

TABLE 2

| | Evaluation of film | |
|---|---|---|
| Test No. | Curved-portion cracking | Planar-portion leakage current (mA) |
| 1 | ○ | 0.01 |
| 2 | ○ | 0.01 |

TABLE 2-continued

| | Evaluation of film | |
|---|---|---|
| Test No. | Curved-portion cracking | Planar-portion leakage current (mA) |
| 3 | ○ | 0.03 |
| 4 | ○ | 0.01 |
| 5 | ○ | 0.01 |
| 6 | ○ | 0.03 |
| 7 | ○ | 0.04 |
| 8 | ○ | 0.05 |
| 9 | ○ | 0.02 |
| 10 | ○ | 0.02 |
| 11 | X | 0.02 |
| 12 | X | 0.02 |
| 13 | X | 0.03 |
| 14 | X | 0.02 |
| 15 | X | 0.03 |

The following consideration can be made from such results. Test Nos. 1 to 10 are examples that each satisfy the requirements defined in the invention, in each of which curved-portion cracking does not occur, and good withstand voltage characteristics (low leakage current) are shown. Each of Test Nos. 7 and 8 is an example having no second layer, showing a slightly high value of the leakage current.

In contrast, each of Nos. 11 to 15 is a comparative example that does not satisfy at least one of the requirements defined in the invention, and is degenerated in at least one of properties. Among them, Test Nos. 11 and 12 are each a comparative example having the first layer (top-side layer) configured of an anodized film having a degree of film formation of less than 1.3 and having no second layer, in which the withstand voltage characteristics are good in the planar portion having no crack, but the withstand voltage of the anodized film as a whole is expected to be low because curved-portion cracking occurs.

In each of Test Nos. 13 and 14, a thickness percentage of the top-side film is insufficiently small, and curved-portion cracking occurs. Test No. 15 is an example having a top-side film configured of an anodized film having a degree of film formation of less than 1.3, showing curved-portion cracking.

INDUSTRIAL APPLICABILITY

In the invention, the top-side anodized film has a degree of film formation of 1.3 or more, the degree of film formation being defined by Formula (1), and has a thickness percentage of 3% or more relative to the entire film thickness, thereby the curved-portion cracking is suppressed, so that corrosion of a substrate under corrosive gas atmosphere and degradation in withstand voltage characteristics due to film cracking are suppressed, and consequently an anodized aluminum film having excellent withstand voltage characteristics is produced:

Degree of film formation =(thickness of anodized film)/(substrate thickness loss by anodization) (1).

The invention claimed is:

1. An anodized aluminum film formed on an anodized surface of a substrate comprising aluminum or an aluminum alloy, wherein the anodized aluminum film is formed within a thickness loss of the substrate resulted from anodizing, wherein the anodized aluminum film is an anodized film having at least three laminated anodized films having different film structures, wherein a top-side anodized film of the at least two laminated anodized films has a degree of film formation of 1.3 or more, wherein the degree of film formation is defined by the following Formula:

Degree of film formation=(thickness of top-side anodized film)/(substrate thickness loss by anodization), and wherein the top-side anodized film has a thickness percentage of 3% or more relative to a total anodized aluminum film thickness, thereby suppressing a curve portion cracking.

2. The anodized aluminum film according to claim 1, wherein the total anodized aluminum film thickness is 3 μm or more.

3. The anodized aluminum film of claim 2, wherein the at least three anodized films having different film structures are prepared with different treatment solutions or different treatment conditions.

4. The anodized aluminum film of claim 2, wherein the total anodized aluminum film thickness is 20 μm or more.

5. The anodized aluminum film according to claim 1, wherein the at least three anodized films having different film structures are prepared with different treatment solutions or different treatment conditions.

6. The anodized aluminum film of claim 5, wherein the at least three anodized film having different film structures are prepared with different treatment solutions.

7. The anodized aluminum film of claim 6, wherein at least one of the different treatment solutions comprises an acid.

8. The anodized aluminum film of claim 6, wherein at least one of the different treatment solutions comprises an acid selected from the group consisting of an organic acid, an inorganic acid, and a mixture thereof.

9. The anodized aluminum film of claim 6, wherein at least one of the different treatment solutions comprises at least one selected from the group consisting of oxalic acid, formic acid, phosphoric acid, chromic acid and sulfuric acid.

10. The anodized aluminum film of claim 1, wherein the substrate comprises the aluminum alloy.

11. The anodized aluminum film of claim 10, wherein the aluminum alloy is selected from the group consisting of a 1000 series aluminum alloy, a 5000 series aluminum alloy, and a 6000 series aluminum alloy.

* * * * *